US010712045B2

(12) United States Patent
Van Deventer et al.

(10) Patent No.: US 10,712,045 B2
(45) Date of Patent: Jul. 14, 2020

(54) COMPACT AIR HANDLING UNIT

(71) Applicant: Trane International, Inc., Davidson, NC (US)

(72) Inventors: Patrick William Van Deventer, Tyler, TX (US); John Raymond Edens, Tyler, TX (US); Bradley Lynn Kersh, Flint, TX (US); Randy Joe Semroska, Tyler, TX (US); Mark Hudgins, Whitehouse, TX (US); Caitlin Michelle Butler, Tyler, TX (US)

(73) Assignee: Trane International Inc., Davidson, NC (US)

( * ) Notice: Subject to any disclaimer, the term of this patent is extended or adjusted under 35 U.S.C. 154(b) by 113 days.

(21) Appl. No.: 15/990,133

(22) Filed: May 25, 2018

(65) Prior Publication Data

US 2019/0360722 A1 Nov. 28, 2019

(51) Int. Cl.

| | |
|---|---|
| ***F24F 13/30*** | (2006.01) |
| *F24F 13/20* | (2006.01) |
| *F24F 3/044* | (2006.01) |
| *F24F 7/04* | (2006.01) |

(52) U.S. Cl.

CPC ..... *F24F 13/30* (2013.01); *F24F 3/044* (2013.01); *F24F 7/04* (2013.01); *F24F 13/20* (2013.01); *F24F 2013/205* (2013.01)

(58) Field of Classification Search

CPC .... F24F 13/30; F24F 7/04; F24F 3/044; F24F 2013/205; F24F 13/20; F24F 1/02; F25D 19/02; F25D 23/12

See application file for complete search history.

(56) References Cited

U.S. PATENT DOCUMENTS

| | | | | |
|---|---|---|---|---|
| 2009/0158935 A1* | 6/2009 | Kim | F24F 13/20 96/189 |
| 2012/0144858 A1 | 6/2012 | Logan et al. | |
| 2013/0017774 A1* | 1/2013 | Zorzit | F24F 1/0007 454/239 |

FOREIGN PATENT DOCUMENTS

KR 20010059568 A * 7/2001

* cited by examiner

*Primary Examiner* — Emmanuel E Duke
(74) *Attorney, Agent, or Firm* — Conley Rose, P.C.; J. Robert Brown, Jr.; Gayatry S. Nair

(57) ABSTRACT

An air handling unit comprises a cabinet, a blower assembly positioned within the cabinet, a slab positioned adjacent to and parallel to a vertical side of the cabinet, wherein the slab comprises a heat exchanger assembly, and at least one hinged connector that pivotally connects the slab to the cabinet.

20 Claims, 12 Drawing Sheets

COMPACT AIR HANDLING UNIT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Heating, ventilation, and/or air conditioning (HVAC) systems may generally be used in residential and/or commercial areas for heating and/or cooling to create comfortable temperatures inside those areas. Some HVAC systems may be split-type heat pump systems that have an indoor and outdoor unit and are capable of cooling a comfort zone by operating in a cooling mode for transferring heat from a comfort zone to an ambient zone using a refrigeration cycle and also generally capable of reversing the direction of refrigerant flow through the components of the HVAC system so that heat is transferred from the ambient zone to the comfort zone, thereby heating the comfort zone. Such split-type heat pump systems commonly use an inclined heat exchanger as the indoor heat exchanger due to characteristics such as efficient performance, compact size, and cost effectiveness.

SUMMARY

In an embodiment, an air handling unit is provided including a cabinet, a blower assembly positioned within the cabinet, a slab positioned adjacent to and parallel to a vertical side of the cabinet, wherein the slab comprises a heat exchanger assembly, and at least one hinged connector that pivotally connects the slab to the cabinet.

In another embodiment, a heating, ventilation, and/or air conditioning (HVAC) system is provided including an air handling unit. The air handling unit comprises a cabinet, a slab positioned parallel to a side of the cabinet, wherein the slab comprises a heat exchanger assembly, and at least one hinged connector that pivotally connects the slab to the cabinet.

In another embodiment, a method of operating a HVAC system is provided. The method comprises removing a control panel from a cabinet of an air handling unit of the HVAC system, pivoting a slab of the air handling unit in a downward and outward direction to create an opening in the air handling unit, wherein the slab comprises the heat exchanger assembly, and removing a blower assembly from the air handling unit via the opening.

For the purpose of clarity, any one of the embodiments disclosed herein may be combined with any one or more other embodiments disclosed herein to create a new embodiment within the scope of the present disclosure.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION

It should be understood at the outset that although illustrative implementations of one or more embodiments of the present disclosure are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

In typical air handling units of an HVAC system, a heat exchanger is positioned in an incline toward the bottom of the air handling unit, and a blower assembly is positioned above the heat exchanger and toward the top of the air handling unit. These types of air handling units are typically large in size, and the inclined placement of the heat exchanger within the air handling unit makes it difficult to remove the blower assembly from the air handling unit. For example, when an operator of the air handling unit needs to replace a motor of the blower assembly, the entire air handling unit may have to be disassembled to access the motor of the blower assembly. To overcome these and other drawbacks, embodiments of the present disclosure provide an air handling unit in which a slab including the heat exchanger acts as a pivoting door on a side of the air handling unit. In these embodiments, the blower assembly may easily be removed from the air handing unit by pivoting the slab downward to create an opening in the air handing unit.

Figure 1:
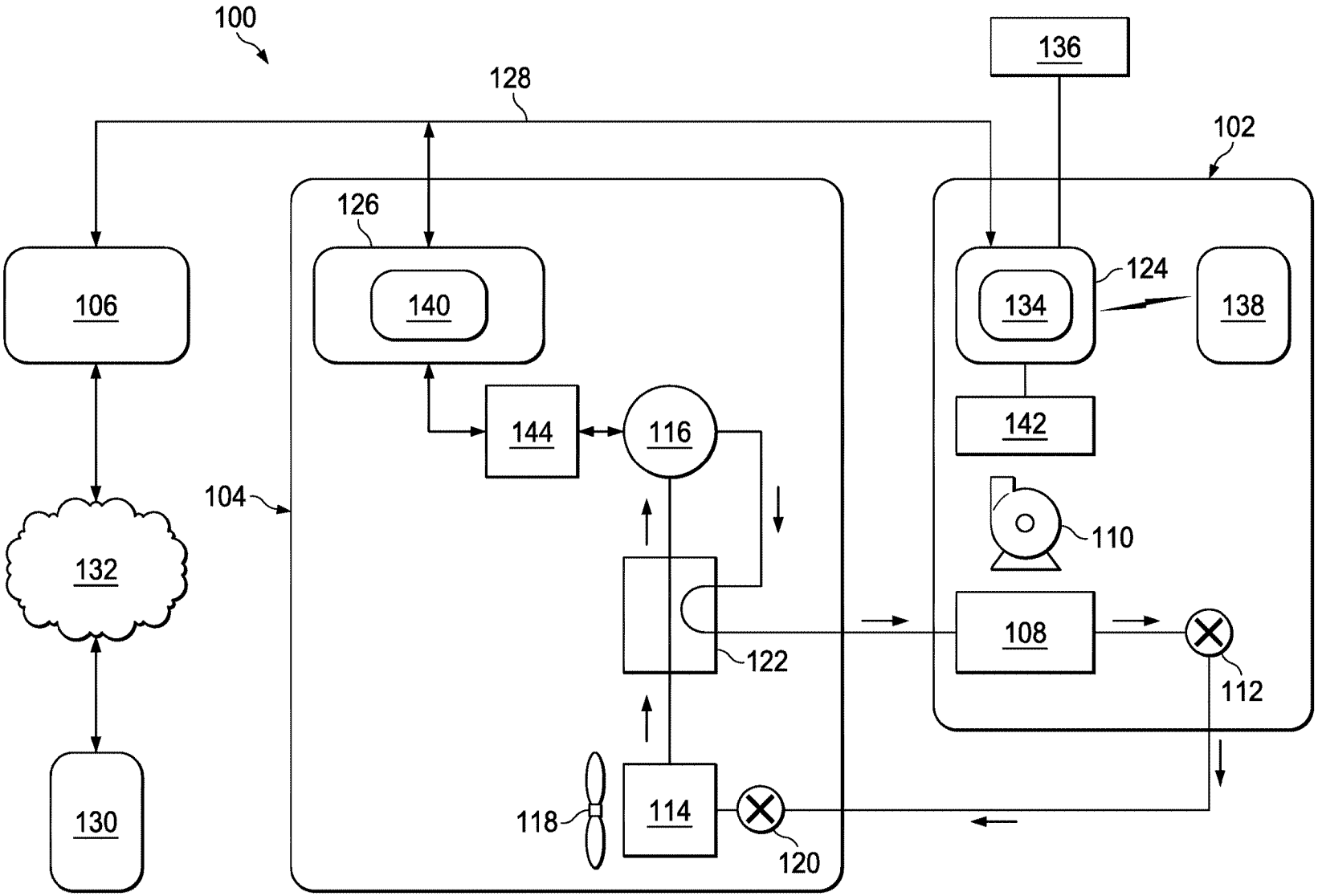
FIG. 1 is a schematic diagram of an HVAC system according to an embodiment of the disclosure.

Referring now to FIG. 1, a schematic diagram of an HVAC system 100 is shown according to an embodiment of the disclosure. Most generally, HVAC system 100 comprises a heat pump system that may be selectively operated to implement one or more substantially closed thermodynamic refrigeration cycles to provide a cooling functionality (hereinafter "cooling mode") and/or a heating functionality (hereinafter "heating mode"). The HVAC system 100, configured as a heat pump system, generally comprises an indoor unit 102, an outdoor unit 104, and a system controller 106 that may generally control operation of the indoor unit 102 and/or the outdoor unit 104.

Indoor unit 102 generally comprises an indoor air handling unit comprising an indoor heat exchanger 108, an indoor fan 110, an indoor metering device 112, and an indoor controller 124. The indoor heat exchanger 108 may generally be configured to promote heat exchange between refrigerant carried within internal tubing of the indoor heat exchanger 108 and an airflow that may contact the indoor heat exchanger 108 but that is segregated from the refrigerant. In some embodiments, the indoor heat exchanger 108 may comprise a plate-fin heat exchanger. However, in other embodiments, indoor heat exchanger 108 may comprise a microchannel heat exchanger and/or any other suitable type of heat exchanger.

The indoor fan 110 may generally comprise a centrifugal blower comprising a blower housing, a blower impeller at least partially disposed within the blower housing, and a blower motor configured to selectively rotate the blower impeller. The indoor fan 110 may generally be configured to provide airflow through the indoor unit 102 and/or the indoor heat exchanger 108 to promote heat transfer between the airflow and a refrigerant flowing through the indoor heat exchanger 108. The indoor fan 110 may also be configured to deliver temperature-conditioned air from the indoor unit 102 to one or more areas and/or zones of a climate controlled structure. The indoor fan 110 may generally comprise a mixed-flow fan and/or any other suitable type of fan. The indoor fan 110 may generally be configured as a modulating and/or variable speed fan capable of being operated at many speeds over one or more ranges of speeds. In other embodiments, the indoor fan 110 may be configured as a multiple speed fan capable of being operated at a plurality of operating speeds by selectively electrically powering different ones of multiple electromagnetic windings of a motor of the indoor fan 110. In yet other embodiments, however, the indoor fan 110 may be a single speed fan.

The indoor metering device 112 may generally comprise an electronically-controlled motor-driven electronic expansion valve (EEV). In some embodiments, however, the indoor metering device 112 may comprise a thermostatic expansion valve, a capillary tube assembly, and/or any other suitable metering device. In some embodiments, while the indoor metering device 112 may be configured to meter the volume and/or flow rate of refrigerant through the indoor metering device 112, the indoor metering device 112 may also comprise and/or be associated with a refrigerant check valve and/or refrigerant bypass configuration when the direction of refrigerant flow through the indoor metering device 112 is such that the indoor metering device 112 is not intended to meter or otherwise substantially restrict flow of the refrigerant through the indoor metering device 112.

Outdoor unit 104 generally comprises an outdoor heat exchanger 114, a compressor 116, an outdoor fan 118, an outdoor metering device 120, a reversing valve 122, and an outdoor controller 126. In some embodiments, the outdoor unit 104 may also comprise a plurality of temperature sensors for measuring the temperature of the outdoor heat exchanger 114, the compressor 116, and/or the outdoor ambient temperature. The outdoor heat exchanger 114 may generally be configured to promote heat transfer between a refrigerant carried within internal passages of the outdoor heat exchanger 114 and an airflow that contacts the outdoor heat exchanger 114 but that is segregated from the refrigerant. In some embodiments, outdoor heat exchanger 114 may comprise a plate-fin heat exchanger. However, in other embodiments, outdoor heat exchanger 114 may comprise a spine-fin heat exchanger, a microchannel heat exchanger, or any other suitable type of heat exchanger.

The compressor 116 may generally comprise a variable speed scroll-type compressor that may generally be configured to selectively pump refrigerant at a plurality of mass flow rates through the indoor unit 102, the outdoor unit 104, and/or between the indoor unit 102 and the outdoor unit 104. In some embodiments, the compressor 116 may comprise a rotary type compressor configured to selectively pump refrigerant at a plurality of mass flow rates. In alternative embodiments, however, the compressor 116 may comprise a modulating compressor that is capable of operation over a plurality of speed ranges, a reciprocating-type compressor, a single speed compressor, and/or any other suitable refrigerant compressor and/or refrigerant pump. In some embodiments, the compressor 116 may be controlled by a compressor drive controller 144, also referred to as a compressor drive and/or a compressor drive system.

The outdoor fan 118 may generally comprise an axial fan comprising a fan blade assembly and fan motor configured to selectively rotate the fan blade assembly. The outdoor fan 118 may generally be configured to provide airflow through the outdoor unit 104 and/or the outdoor heat exchanger 114 to promote heat transfer between the airflow and a refrigerant flowing through the indoor heat exchanger 108. The outdoor fan 118 may generally be configured as a modulating and/or variable speed fan capable of being operated at a plurality of speeds over a plurality of speed ranges. In other embodiments, the outdoor fan 118 may comprise a mixed-flow fan, a centrifugal blower, and/or any other suitable type of fan and/or blower, such as a multiple speed fan capable of being operated at a plurality of operating speeds by selectively electrically powering different multiple electromagnetic windings of a motor of the outdoor fan 118. In yet other embodiments, the outdoor fan 118 may be a single speed fan. Further, in other embodiments, however, the outdoor fan 118 may comprise a mixed-flow fan, a centrifugal blower, and/or any other suitable type of fan and/or blower.

The outdoor metering device 120 may generally comprise a thermostatic expansion valve. In some embodiments, however, the outdoor metering device 120 may comprise an electronically-controlled motor driven EEV similar to indoor metering device 112, a capillary tube assembly, and/or any other suitable metering device. In some embodiments, while the outdoor metering device 120 may be configured to meter the volume and/or flow rate of refrigerant through the outdoor metering device 120, the outdoor metering device 120 may also comprise and/or be associated with a refrigerant check valve and/or refrigerant bypass configuration when the direction of refrigerant flow through the outdoor metering device 120 is such that the outdoor metering device 120 is not intended to meter or otherwise substantially restrict flow of the refrigerant through the outdoor metering device 120.

The reversing valve 122 may generally comprise a four-way reversing valve. The reversing valve 122 may also comprise an electrical solenoid, relay, and/or other device configured to selectively move a component of the reversing valve 122 between operational positions to alter the flow path of refrigerant through the reversing valve 122 and consequently the HVAC system 100. Additionally, the reversing valve 122 may also be selectively controlled by the system controller 106 and/or an outdoor controller 126.

The system controller 106 may generally be configured to selectively communicate with an indoor controller 124 of the indoor unit 102, an outdoor controller 126 of the outdoor unit 104, and/or other components of the HVAC system 100. In some embodiments, the system controller 106 may be configured to control operation of the indoor unit 102 and/or the outdoor unit 104. In some embodiments, the system controller 106 may be configured to monitor and/or communicate with a plurality of temperature sensors associated with components of the indoor unit 102, the outdoor unit 104, and/or the ambient outdoor temperature. Additionally, in some embodiments, the system controller 106 may comprise a temperature sensor and/or may further be configured to control heating and/or cooling of zones associated with the HVAC system 100. In other embodiments, however, the system controller 106 may be configured as a thermostat for controlling the supply of conditioned air to zones associated with the HVAC system 100.

The system controller 106 may also generally comprise an input/output (I/O) unit (e.g., a graphical user interface, a touchscreen interface, or the like) for displaying information and for receiving user inputs. The system controller 106 may display information related to the operation of the HVAC system 100 and may receive user inputs related to operation of the HVAC system 100. However, the system controller 106 may further be operable to display information and receive user inputs tangentially and/or unrelated to operation of the HVAC system 100. In some embodiments, however, the system controller 106 may not comprise a display and may derive all information from inputs from remote sensors and remote configuration tools.

In some embodiments, the system controller 106 may be configured for selective bidirectional communication over a communication bus 128. In some embodiments, portions of the communication bus 128 may comprise a three-wire connection suitable for communicating messages between the system controller 106 and one or more of the HVAC system 100 components configured for interfacing with the communication bus 128. Still further, the system controller 106 may be configured to selectively communicate with HVAC system 100 components and/or any other device 130 via a communication network 132. In some embodiments, the communication network 132 may comprise a telephone network, and the other device 130 may comprise a telephone. In some embodiments, the communication network 132 may comprise the Internet, and the other device 130 may comprise a smartphone and/or other Internet-enabled mobile telecommunication device. In other embodiments, the communication network 132 may also comprise a remote server.

The indoor controller 124 may be carried by the indoor unit 102 and may generally be configured to receive information inputs, transmit information outputs, and/or otherwise communicate with the system controller 106, the outdoor controller 126, and/or any other device 130 via the communication bus 128 and/or any other suitable medium of communication. In some embodiments, the indoor controller 124 may be configured to communicate with an indoor personality module 134 that may comprise information related to the identification and/or operation of the indoor unit 102. In some embodiments, the indoor controller 124 may be configured to receive information related to a speed of the indoor fan 110, transmit a control output to an electric heat relay, transmit information regarding an indoor fan 110 volumetric flow-rate, communicate with and/or otherwise affect control over an air cleaner 136, and communicate with an indoor EEV controller 138. In some embodiments, the indoor controller 124 may be configured to communicate with an indoor fan controller 142 and/or otherwise affect control over operation of the indoor fan 110. In some embodiments, the indoor personality module 134 may comprise information related to the identification and/or operation of the indoor unit 102 and/or a position of the outdoor metering device 120.

The indoor EEV controller 138 may be configured to receive information regarding temperatures and/or pressures of the refrigerant in the indoor unit 102. More specifically, the indoor EEV controller 138 may be configured to receive information regarding temperatures and pressures of refrigerant entering, exiting, and/or within the indoor heat exchanger 108. Further, the indoor EEV controller 138 may be configured to communicate with the indoor metering device 112 and/or otherwise affect control over the indoor metering device 112. The indoor EEV controller 138 may also be configured to communicate with the outdoor metering device 120 and/or otherwise affect control over the outdoor metering device 120.

The outdoor controller 126 may be carried by the outdoor unit 104 and may be configured to receive information inputs, transmit information outputs, and/or otherwise communicate with the system controller 106, the indoor controller 124, and/or any other device 130 via the communication bus 128 and/or any other suitable medium of communication. In some embodiments, the outdoor controller 126 may be configured to communicate with an outdoor personality module 140 that may comprise information related to the identification and/or operation of the outdoor unit 104. In some embodiments, the outdoor controller 126 may be configured to receive information related to an ambient temperature associated with the outdoor unit 104, information related to a temperature of the outdoor heat exchanger 114, and/or information related to refrigerant temperatures and/or pressures of refrigerant entering, exiting, and/or within the outdoor heat exchanger 114 and/or the compressor 116. In some embodiments, the outdoor controller 126 may be configured to transmit information related to monitoring, communicating with, and/or otherwise affecting control over the compressor 116, the outdoor fan 118, a solenoid of the reversing valve 122, a relay associated with adjusting and/or monitoring a refrigerant charge of the HVAC system 100, a position of the indoor metering device 112, and/or a position of the outdoor metering device 120. The outdoor controller 126 may further be configured to communicate with and/or control a compressor drive controller 144 that is configured to electrically power and/or control the compressor 116.

The HVAC system 100 is shown configured for operating in a so-called heating mode in which heat may generally be absorbed by refrigerant at the outdoor heat exchanger 114 and rejected from the refrigerant at the indoor heat exchanger 108. Starting at the compressor 116, the compressor 116 may be operated to compress refrigerant and pump the relatively high temperature and high pressure compressed refrigerant through the reversing valve 122 and to the indoor heat exchanger 108, where the refrigerant may transfer heat to an airflow that is passed through and/or into contact with the indoor heat exchanger 108 by the indoor fan 110. After exiting the indoor heat exchanger 108, the refrigerant may flow through and/or bypass the indoor metering device 112, such that refrigerant flow is not substantially restricted by the indoor metering device 112. Refrigerant generally exits the indoor metering device 112 and flows to the outdoor metering device 120, which may meter the flow of refrigerant through the outdoor metering device 120, such that the refrigerant downstream of the outdoor metering device 120 is at a lower pressure than the refrigerant upstream of the outdoor metering device 120. From the outdoor metering device 120, the refrigerant may enter the outdoor heat exchanger 114. As the refrigerant is passed through the outdoor heat exchanger 114, heat may be transferred to the refrigerant from an airflow that is passed through and/or into contact with the outdoor heat exchanger 114 by the outdoor fan 118. Refrigerant leaving the outdoor heat exchanger 114 may flow to the reversing valve 122, where the reversing valve 122 may be selectively configured to divert the refrigerant back to the compressor 116, where the refrigeration cycle may begin again.

Alternatively, to operate the HVAC system 100 in a so-called cooling mode, most generally, the roles of the indoor heat exchanger 108 and the outdoor heat exchanger 114 are reversed as compared to their operation in the above-described heating mode. For example, the reversing valve 122 may be controlled to alter the flow path of the refrigerant from the compressor 116 to the outdoor heat exchanger 114 first and then to the indoor heat exchanger 108, the indoor metering device 112 may be enabled, and the outdoor metering device 120 may be disabled and/or bypassed. In cooling mode, heat may generally be absorbed by refrigerant at the indoor heat exchanger 108 and rejected by the refrigerant at the outdoor heat exchanger 114. As the refrigerant is passed through the indoor heat exchanger 108, the indoor fan 110 may be operated to move air into contact with the indoor heat exchanger 108, thereby transferring heat to the refrigerant from the air surrounding the indoor heat exchanger 108. Additionally, as refrigerant is passed through the outdoor heat exchanger 114, the outdoor fan 118 may be operated to move air into contact with the outdoor heat exchanger 114, thereby transferring heat from the refrigerant to the air surrounding the outdoor heat exchanger 114.

Figure 2A:
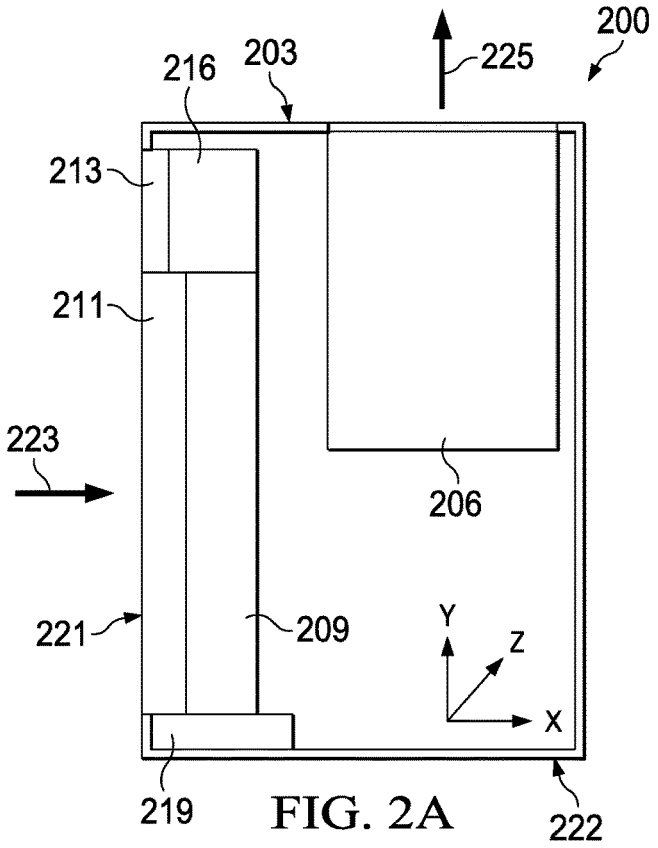
FIGS. 2A and 2B are schematic diagrams of an air handling unit in a closed position and an open position according to an embodiment of the disclosure.
Figure 2B:
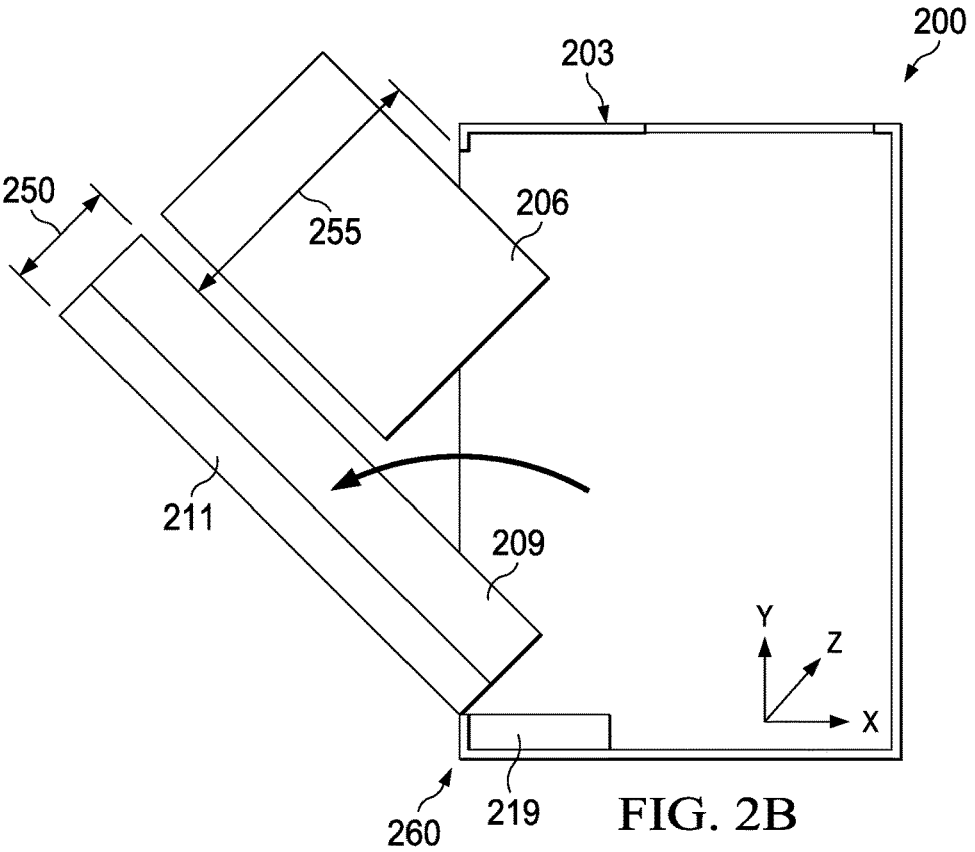

Referring now to FIGS. 2A and 2B, schematic diagrams of an air handling unit 200 are shown according to an embodiment of the disclosure. FIG. 2A is a schematic diagram of an air handling unit 200 in a closed position according to an embodiment of the disclosure. FIG. 2B is a schematic diagram of an air handling unit 200 in an open position according to an embodiment of the disclosure.

As shown in FIG. 2A, the air handling unit 200 may generally be configured as the indoor unit 102 of FIG. 1. In an embodiment, the air handling unit 200 may comprise a cabinet 203 which houses a blower assembly 206, a heat exchanger assembly 209, an air filter 211, a control panel cover 213, a control panel 216, and a drain pan 219. As should be appreciated, the air handling unit 200 may comprise additional components that are not depicted in FIGS. 2A and 2B. As shown in FIG. 2A, the air handling unit 200 may comprise many surfaces or sides, such as the vertical side 221 and the base 222. The vertical side 221 may refer the surface of the air handling unit 200 proximate to the heat exchanger 209, and the base 222 may refer to the bottom surface of the air handling unit 200.

In an embodiment, the cabinet 203 may enclose the blower assembly 206 and the control panel 216. As described below with reference to FIG. 2B, the cabinet 203 is configured to open such that the blower assembly 206 may be removed from the air handling unit 200 without having to disassemble the entire air handling unit 200. In an embodiment, the cabinet 203 may comprise the control panel cover 213 that covers and protects the control panel 216.

In an embodiment, the blower assembly 206 is substantially similar to the indoor fan 110 of FIG. 1. According to some aspects, the blower assembly 206 may be selectively removable from the air handling unit 200, as described below with reference to FIG. 2B. The blower assembly 206 may generally comprise an electrically powered, motor driven rotatable blower that may be configured to deliver an airflow through the air handling unit 200.

In some embodiments, the air handling unit 200 may include a heat exchanger assembly 209 disposed substantially on a side of the blower assembly 202. The heat exchanger assembly 209 may supply airflow by drawing air toward the blower assembly 202. The heat exchanger assembly 209 may generally be configured as and/or employed as the indoor heat exchanger 108 of FIG. 1. The heat exchanger assembly 209 may be disposed within a fluid duct of the air handling unit 200.

The heat exchanger assembly 209 may generally be configured to promote heat transfer between a refrigerant carried within internal tubing of the heat exchanger assembly 209 and an airflow that contacts the heat exchanger assembly 209 but that is segregated from the refrigerant. In some implementations, the internal tubing of the heat exchanger assembly 209 may comprise liquid circuit tubing and gas circuit tubing, as will be further described below with reference to FIGS. 6A-B. In some embodiments, the heat exchanger assembly 209 comprises a spine-fine heat exchanger, a microchannel heat exchanger, or any other suitable type of heat exchanger.

In some embodiments, the heat exchanger assembly 209 is substantially planar and parallel to a side 221 of the of the air handling unit 200. For example, the heat exchanger assembly 209 is not slanted relative to the positioning of the blower assembly 203 and is instead positioned vertically up against an air filter 211 or against a side 221 of the air handling unit 200. Such a vertical arrangement of the heat exchanger assembly 209 is advantageous in that the height and size of the air handling unit 200 is decreased from a typical air handling unit 200. For example, positioning the heat exchanger assembly 209 against the side 221 allows for the blower assembly 206 to be positioned substantially on a side of the heat exchanger assembly 209 instead of above or below the heat exchanger assembly 209. In some embodiments, the heat exchanger assembly 209 and the air filter 211 may define the vertical side 221 of the cabinet 203.

In the implementation depicted in FIG. 2A, the heat exchanger assembly 209 is adjacent to an air filter. In this implementation, the heat exchanger assembly 209 is closer in proximity to the blower exchange assembly 206 than the air filter 211. The air filter 211 may be composed of fibrous materials and configured to remove solid particles such as dust, pollen, mold, and bacteria from the air supply entering into the air handling unit 200.

In some implementations, the control panel 216 of the air handling unit 200 comprises the electrical components. In an embodiment, the control panel cover 213 is detachably attachable to the cabinet 203. For example, the control panel may be attached onto the cabinet 203 using screws.

In some embodiments, the air handling unit 200 may comprise at least one drain pan 219 disposed at a lower end of the air filter 211 and heat exchanger assembly 209 and proximate to the base 222. In some implementations, the drain pan 219 is disposed directly under the air filter 211 and at least partially under the heat exchanger assembly 209. In some implementations, condensation that forms and drips from the heat exchanger assembly 209 is directed into the drain pan 219. As described further below with reference to FIG. 7, the drain pain 219 may comprise one or more vertical supports configured to support the air filter 211 in a manner such that the air filter 211 does not contact the condensation collected in the drain pan 219.

In operation, an air supply 223 is provided through the air filter 211 and then passed through the heat exchanger assembly 209, which is configured to heat or cool the air supply based on the mode of the HVAC system. Upon passing through the heat exchanger assembly 209, the air supply 223 is then passed through the blower assembly 206 and outside the air handling unit 200 into ducts that provide conditioned air to zones in the dwelling.

Referring now to FIG. 2B, a schematic diagram of an air handling unit 200 in an open position is shown according to an embodiment of the disclosure. The air handling unit 200 may be opened such that one or more components of the blower assembly 206 may be removed via the opening 255. The air handling unit 200 shown in FIG. 2B is similar to the air handling unit 200 shown in FIG. 2A, except that the air handling unit 200 shown in FIG. 2B is in an open position. The air handling unit 200 shown in FIG. 2B further comprises a slab 250, an opening 255, and a bottom corner 260. For purposes of this discussion, the slab 250 may refer to both the air filter 211 and the heat exchanger assembly 209. In another implementation in which the air handling unit 200 does not include the air filter 211, the slab 250 may refer to the heat exchanger assembly 209. In some embodiments, the slab 250 may be positioned adjacent to the vertical side 221 of the cabinet 203. In some embodiments, the slab 250 may define the vertical side 221 of the cabinet 203.

The opening 255 may refer to a gap that is formed in the air handling unit 200 when the slab 250 is pivoted into an open position. One or more components of the blower assembly 206 may be removed from the air handling unit 200 and inserted back into the air handling unit 200 using the opening 255. In this way, the components of the blower assembly 206 can be repaired or replaced without having to disassemble the entire air handling unit 200. As should be appreciated, other components housed within the cabinet 203 may also be selectively removed from the air handling unit 200 via the opening 255.

In some embodiments, the air handling unit 200 is configured to open by first removing the control panel cover 213 and then removing the control panel 216, as is further described below with reference to FIGS. 3A-C. As shown in FIG. 2B, the control panel cover 213 and the control panel 216 have been removed when the air handling unit 200 is in an open position. It will be appreciated that, in other configurations, the control panel 216 may be coupled such that the control panel 216 pivots with the slab 250 or the control panel 216 may be positioned elsewhere to avoid having to remove the control panel 216 to access the blower assembly 206.

After the control panel cover 213 and the control panel 216 have been removed from the cabinet 203, the air handling unit 200 may be opened by pivoting the slab 250 in a downward and outward direction toward the base 222 of the air handling unit 200. The pivoting mechanism may be enabled by a hinged interconnection between the slab 250 and the bottom corner 260 of the cabinet 203. The slab 250 and the cabinet 203 may be pivotally connected at the bottom corner 260 using a hinge that enables the slab 250 to pivot outward and downward in the y-axis about a bottom corner 260. In some embodiments, the slab 250 may comprise a frame that is configured to hold and secure the heat exchanger assembly 209 and/or the air filter 211. For example, the hinge may be pivotally connected to the frame of the slab 250 with the cabinet 203. Additional details of the structure that enables the pivoting mechanism is described below with reference to FIGS. 4A-B.

Figure 3A:
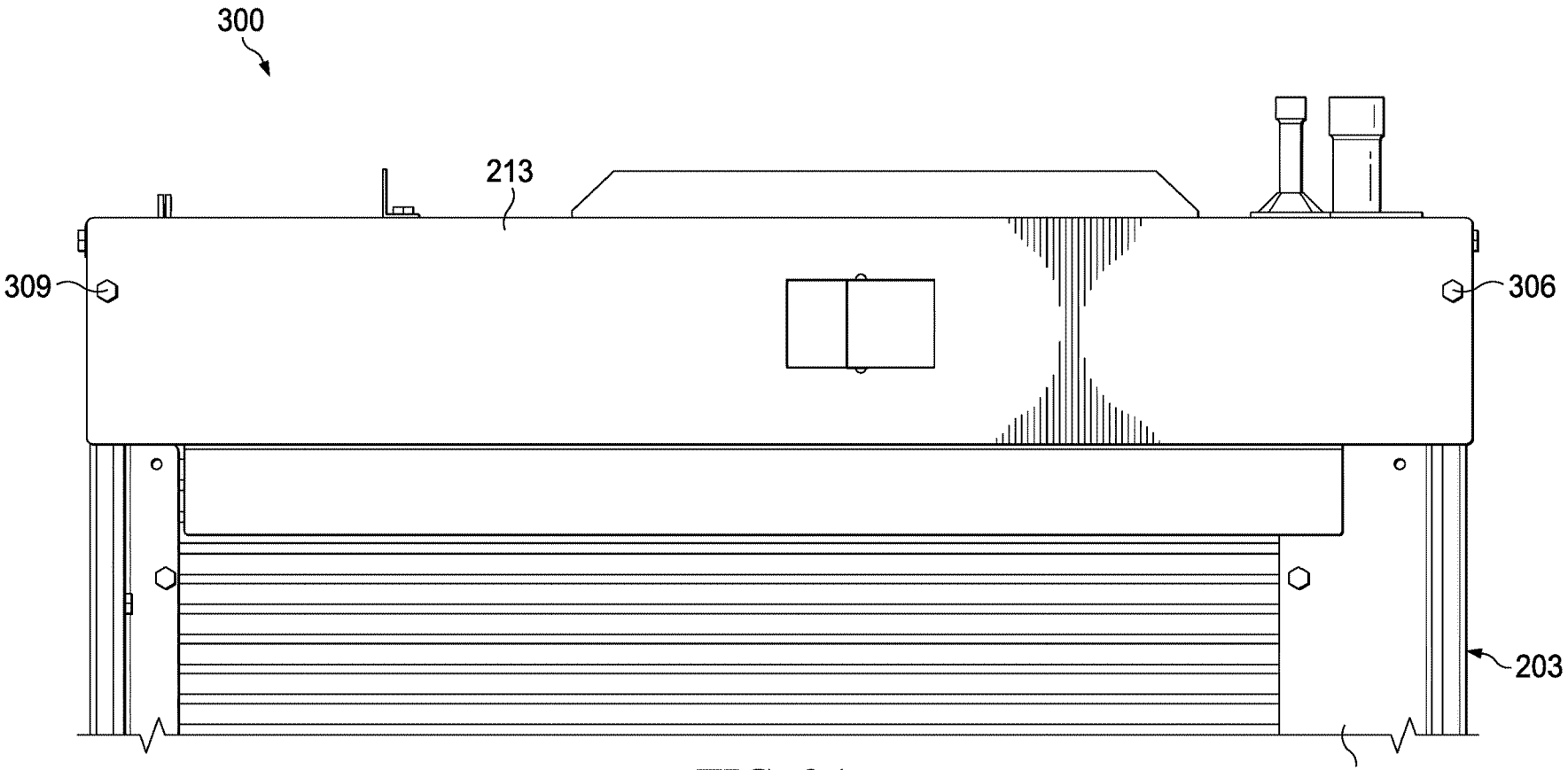
FIGS. 3A-3C are schematic diagrams illustrating a method of removing a control panel from an air handling unit according to an embodiment of the disclosure.
Figure 3B:
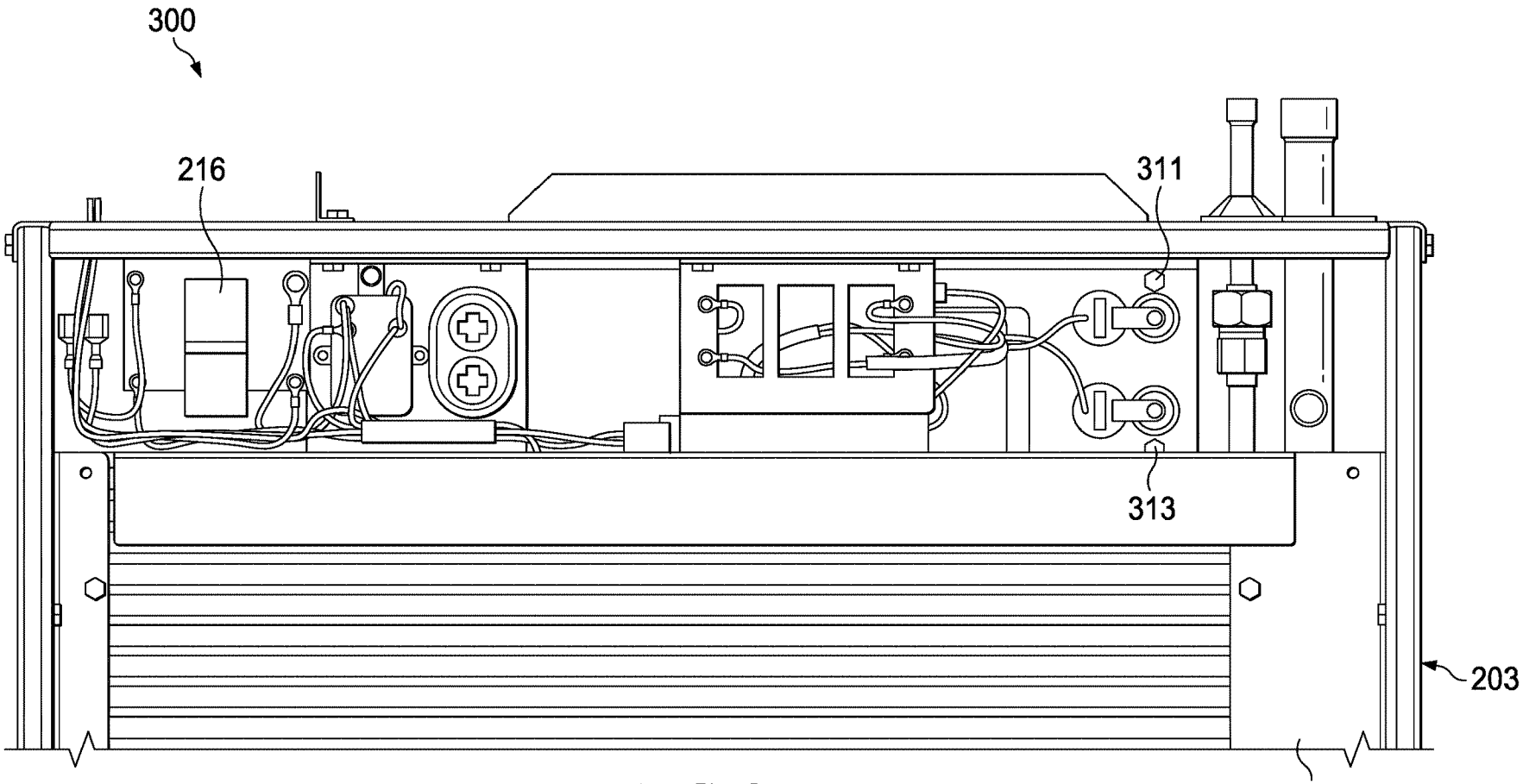
Figure 3C:
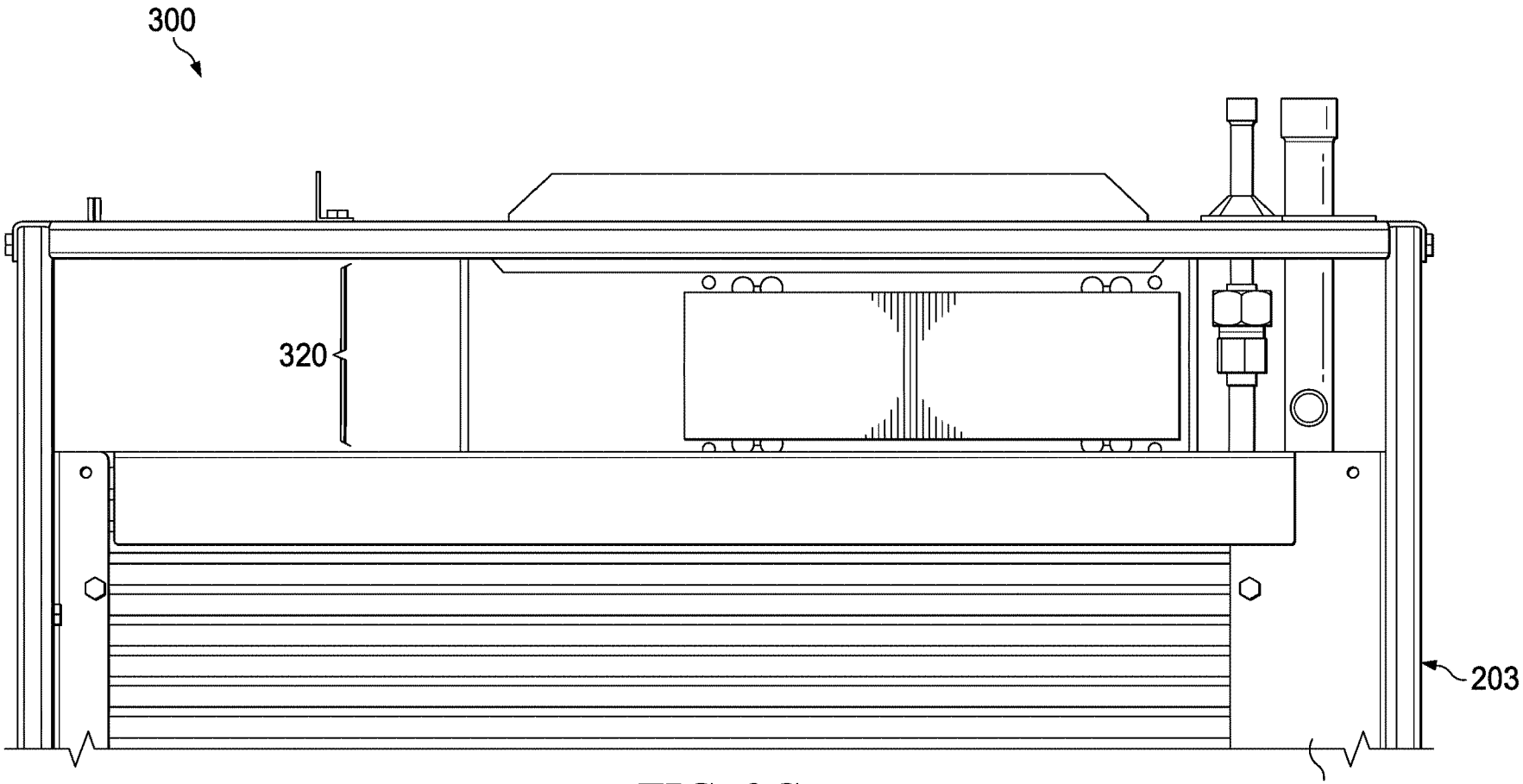

Referring now to FIGS. 3A-C, schematic diagrams illustrating a method of removing the control panel cover 213 and the control panel 216 from the air handling unit 200 are shown according to an embodiment of the disclosure. Referring now to FIG. 3A, a schematic diagram illustrating a portion 300 of the air handling unit 200 before removing the control panel cover 213 is shown according to an embodiment of the disclosure. The portion 300 of the air handling unit 200 comprises the control panel cover 213 and the slab 250. In the implementation depicted in FIG. 3A, the control panel cover 213 is disposed above the slab 250 and is part of the cabinet 203. In some embodiments, the control panel cover 213 is detachably attachable to the cabinet 203 using connectors 306 and 309. Connectors 306 and 309 may be any attachment that is configured to detachably attach the control panel cover 213 to the cabinet 203. For example, connectors 306 and 309 may be screws used to attach the control panel cover 213 to the cabinet 203 such that the control panel cover 213 protects the control panel 216.

While the connectors 306 and 309 are shown at the sides of the control panel 216, it should be appreciated that the connectors 306 and 309 may be placed anywhere on the control panel cover 312. While two connectors 306 and 309 are shown in FIG. 3A, it should be appreciated that any number of connectors may be used to detachably attach the control panel cover 213 to the cabinet 203.

Referring now to FIG. 3B, a schematic diagram illustrating a portion 300 of the air handling unit 200 after removing the control panel cover 213 and before removing the control panel 216 from the cabinet 203 is shown according to an embodiment of the disclosure. For example, an operator of the air handling unit 200 may remove the control panel cover 213 by first removing the connectors 306 and 309 that fix the control panel cover 213 to the cabinet 203 and then removing the control panel cover 213 from the cabinet 203. After the control panel cover 213 is removed from the cabinet 203, the control panel 216 is accessible. For example, an operator of the air handling unit 200 may adjust the refrigerant flow or electrical connections of the air handling unit 200 by accessing the control panel 216.

In some embodiments, the control panel 216 may be connected to and secured to the cabinet 203 using connectors 311 and 313. Similar to connectors 306 and 309, the connectors 311 and 313 may be any attachment that is configured to attach the control panel 216 to the cabinet 203. For example, connectors 311 and 313 may be screws used to detachably attach the control panel 216 to the cabinet 203.

While the connectors 311 and 313 are shown at the top and bottom of the control panel 216, it should be appreciated that the connectors 311 and 313 may be placed anywhere on the control panel 216. While two connectors 311 and 313 are shown in FIG. 3B, it should be appreciated that any number of connectors may be used to detachably attach the control panel 216 to the cabinet 203.

Referring now to FIG. 3C, a schematic diagram illustrating a portion 300 of the air handling unit 200 after removing the control panel 216 from the cabinet 203 is shown according to an embodiment of the disclosure. As shown in FIG. 3C, after the control panel cover 213 and the control panel 216 are removed from the cabinet 203, a small gap 320 is formed at the top of the air handling unit 200 above the slab 250. In some implementations, the small gap 230 may be used by an operator to grip the slab 250 and begin the pivoting motion of the slab 250 downward and outward.

Figure 4A:
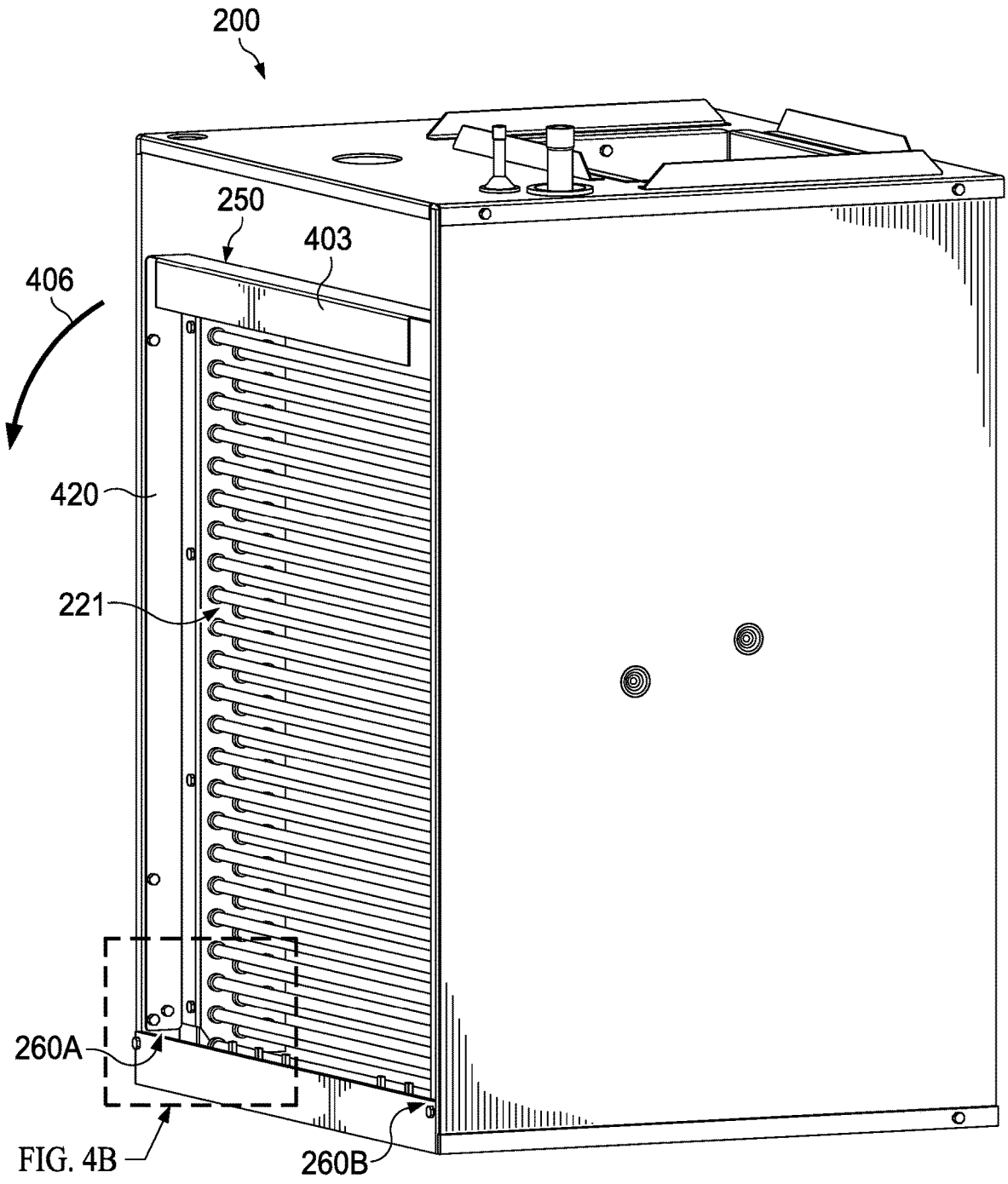
FIG. 4A is a schematic diagram of a side view of the air handling unit in a closed position according to an embodiment of the disclosure.
Figure 4B:
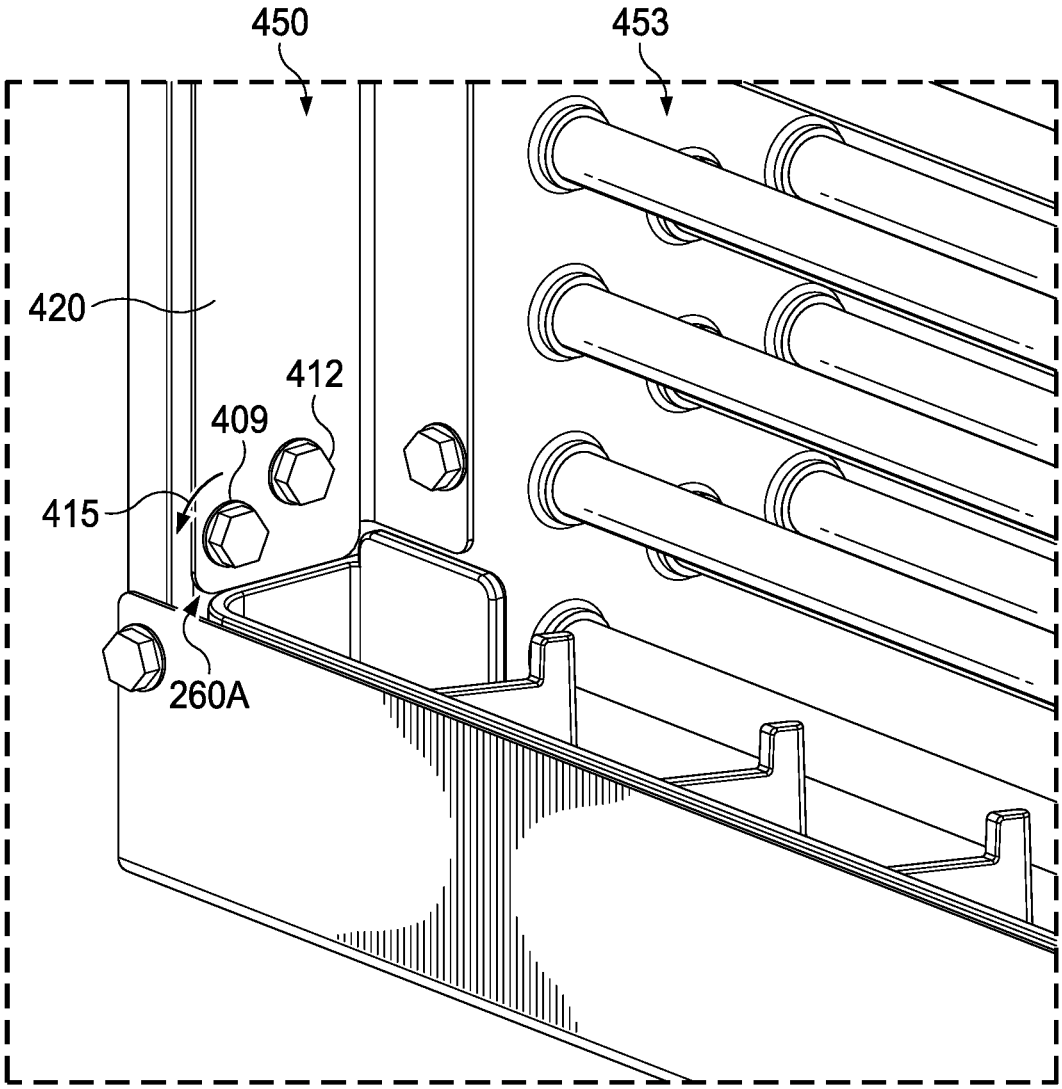
FIG. 4B is a schematic diagram of an exploded view of a bottom corner of the air handling unit according to an embodiment of the disclosure.

Referring now to FIGS. 4A-B, a schematic diagram of a side view of the air handling unit 200 in a closed position with the air filter 211 removed from the slab 250 is shown according to an embodiment of the disclosure. As shown in FIG. 4A, the vertical side 221 may be the slab 250 of the air handling unit 200. As shown in FIG. 4A, the slab 250 may comprise a frame 420 that is a structure that surrounds or encloses the slab 250 to secure and hold the slab. In some embodiments, the frame 420 and the slab 250 may be a side panel of the cabinet 203 such that the cabinet 203 opens when the frame 420 securing the slab 250 is pivoted downward and outward. As shown in FIG. 4B, which depicts an exploded view of a bottom corner 260A of the air handling unit 200, the frame 420 may comprise one or more slots 450 and 453 that are configured to secure the heat exchanger assembly 209 and/or the air filter 211 to the frame 420. While the implementation shown in FIGS. 4A-B do not show the air filter 211, the frame 420 may comprise a slot 450 that is configured to secure the air filter 211 to the frame 420. In some embodiments, inner edges of the slot 450 may abut the outer edges of the air filter 211 to secure the air filter to the frame 420. Similarly, the frame 420 may comprise another slot 453 that is configured secure the heat exchanger assembly 209 to the frame 420. In some embodiments, inner edges of the slot 453 may abut the outer edges of the heat exchanger assembly 209 to secure the heat exchanger assembly 209 to the frame 420. In some embodiments, the heat exchanger assembly 209 may be further secured to the frame 420 using attachments, such as screws. In some embodiments, the cabinet 203 also comprises edges 415 proximate to the frame 420. In some embodiments, the frame 420 may be housed within the edges 415 of the cabinet 203.

As shown in FIG. 4A, the slab 250 may comprise a handle 403, such that an operator may hold the handle 403 and pivot the slab 250 downward and outward, as shown by arrow 406. For example, the handle 403 may be attached to a top edge of the frame 420. In some embodiments, when the operator pivots the slab 250 downward and outwards, the slab 250 pivots on hinges located at the bottom corners 260A and 260B using one or more hinged connectors 409 and one or more stops 412. For example, as shown in FIG. 4B, the bottom corner 260A comprises at least one hinged connector 409 and at least one stop 412, and the bottom corner 260B comprises at least one hinged connector 409 and at least one stop 412. In some implementations, the hinged connectors 409 connect the frame 420 of the slab 250 to the cabinet 203. As shown in FIG. 4B, the hinged connectors 409 and the stops 412 are positioned on the slot 450 of the frame 420. However, it should be appreciated that the hinged connectors 409 and the stops 412 may be positioned anywhere on the frame 420. The hinged connectors 409 may be any connector configured to connect the slab 250 to the cabinet 203 such that the slab 250 may hinge axially about the point of the hinged connectors 409. For example, the hinged connectors 409 may be screws that engage the slab 250 and the cabinet 203 and acts as the hinges on the bottom corners 260A and 26B.

In some embodiments, the stops 412 may be any attachment that attaches onto the slab 250 or cabinet 203. In some embodiments, the stops 412 may be positioned a predefined distance away from the hinged connectors 409 and edges 415 of the cabinet 203. In some embodiments, the stops 412 act as a mechanical stop to the limit pivoting mechanism of the slab 250. For example, as the slab 250 pivots downward and outward, the stops 412 move toward the edges 415 of the cabinet 203. In this case, when the stops 412 meet the edges 415 of the cabinet 203, the slab 250 is prohibited from further pivoting downward and outward. In an embodiment, the stops 412 may be positioned a predefined distance away from the hinged connectors 409 and the edges 415 of the cabinet 203. For example, when the air handling unit 200 is in an open position and the stops 412 meet the edges 415, the opening 255 may have a gap of a certain predefined distance that permits the blower assembly 206 to be removed from the air handling unit 200 via opening 255.

Figure 5:
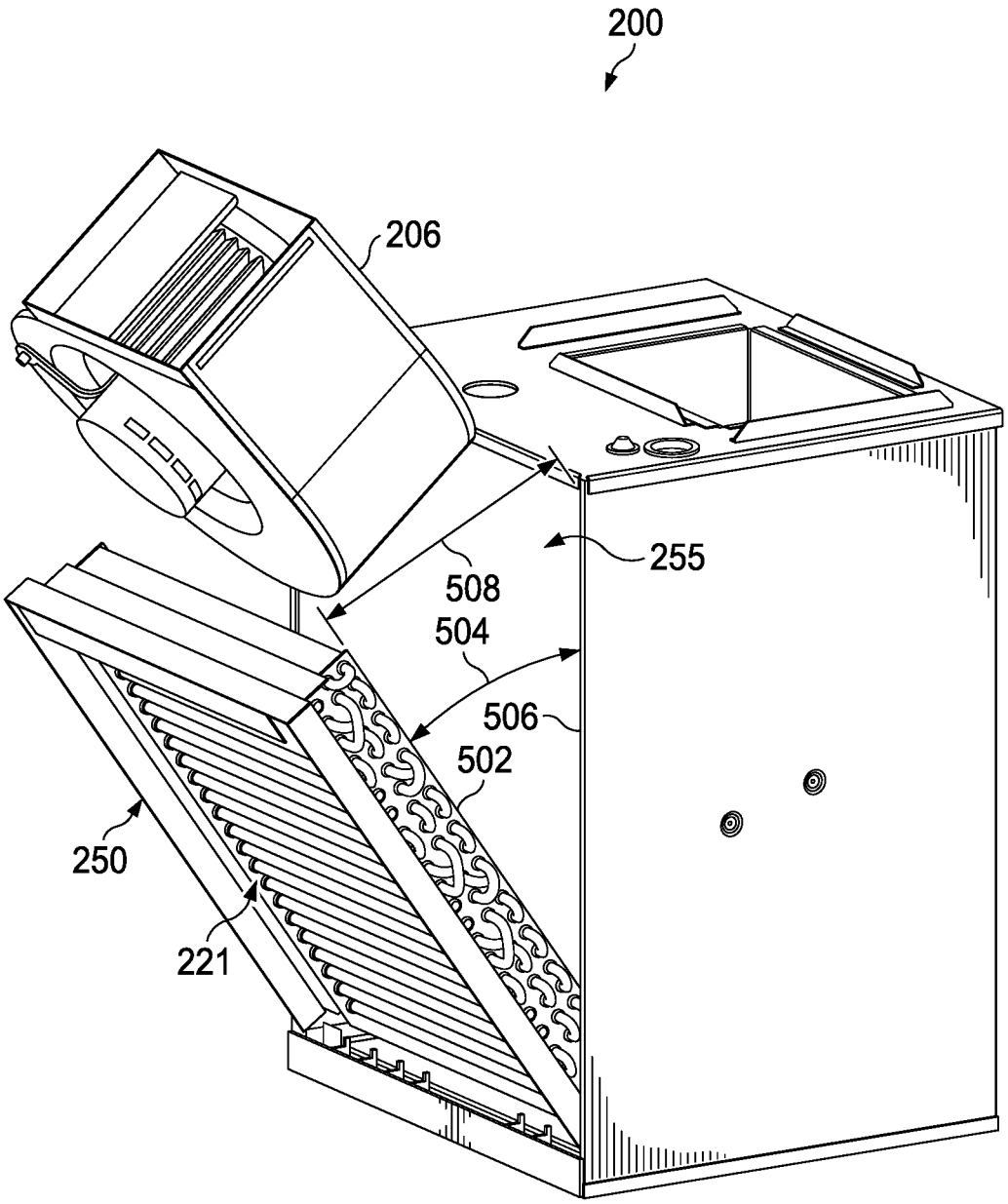
FIG. 5 is a schematic diagram of the air handling unit in an open position according to an embodiment of the disclosure.

Referring now to FIG. 5, a schematic diagram of the air handling unit 200 in an open position such that the blower assembly 206 may be removed from the air handling unit 200 is shown according to an embodiment of the disclosure. As shown in FIG. 5, the blower assembly 206 is removed from the air handling unit 200 via the opening 255. In some implementations, the blower assembly 206 may be attached to the cabinet 203 via one or more screws that may be removed before removing the blower assembly 206 from the cabinet 203 via opening 255. In some embodiments, the opening 255 may be a predefined distance 508 such that the blower assembly 206 may be removed via the opening 255. In some embodiments, an angle 504 between an inner surface 502 of the slab 250 and an edge 506 of the cabinet 203 may be sufficient to remove the blower assembly 206 from the cabinet 203. For example, the angle 504 may be an acute angle, and the slab 250 may be prevented from opening farther than the acute angle 504. For example, the hinged connectors 409 and the stops 412 may be positioned on the slab 250 and the cabinet 203 to provide the opening 255 having the predefined distance 508 and the angle 504.

In some embodiments, the hinged connectors 409 and the stops 412 are positioned to minimize the angle 504 between the inner surface 502 of the slab 250 and the edge 506 of the cabinet 203. For example, the angle 504 may be the minimum angle sufficient to remove the blower assembly 206 from the cabinet 203. By minimizing the angle 504 between the inner surface 502 of the slab 250 and the edge 506 of the cabinet 203, bending of the internal refrigerant tubing that provides the refrigerant to the heat exchanger assembly 209 is also minimized.

Figure 6A:
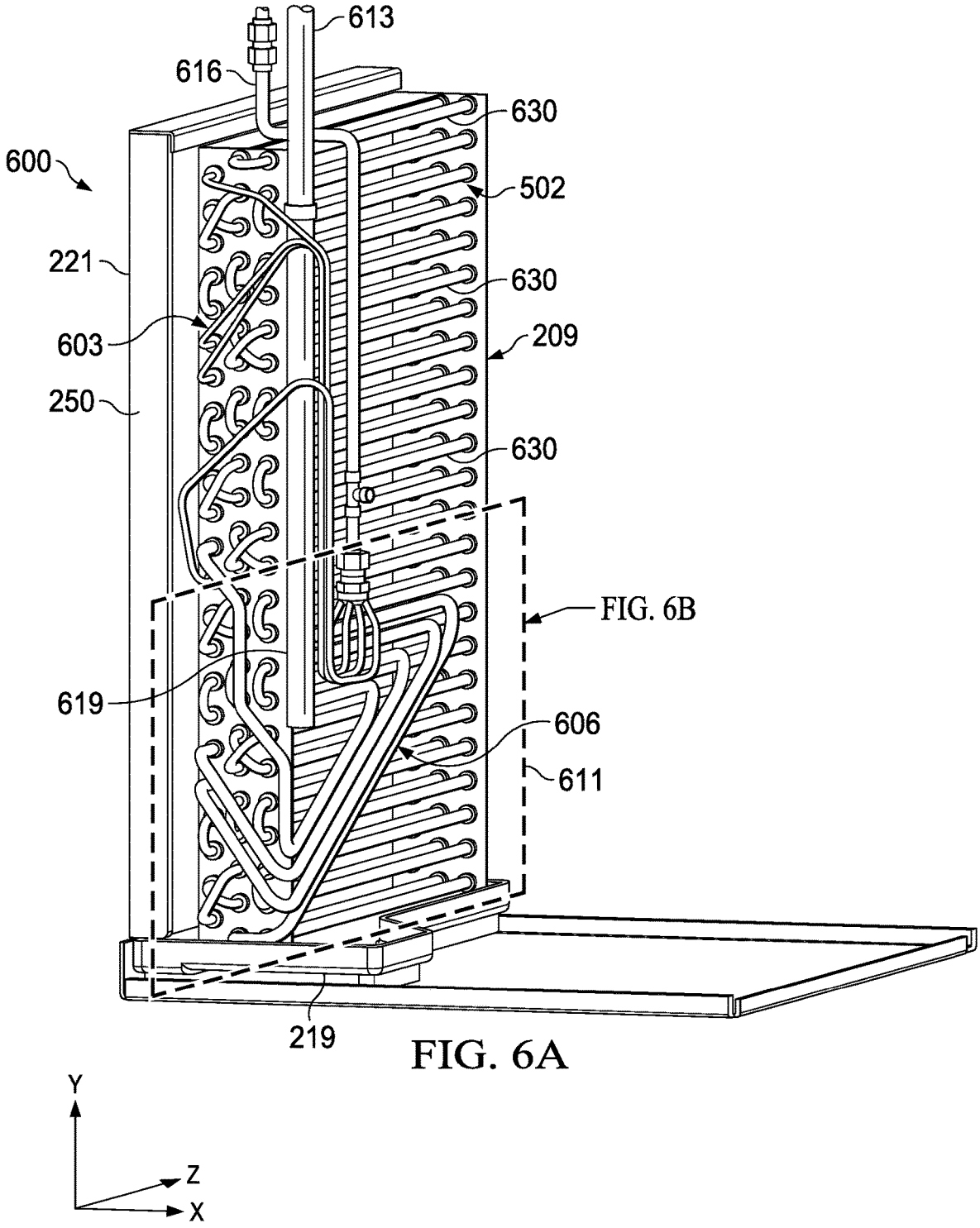
FIG. 6A is a schematic diagram of an interior portion of the air handling unit according to an embodiment of the disclosure.
Figure 6B:
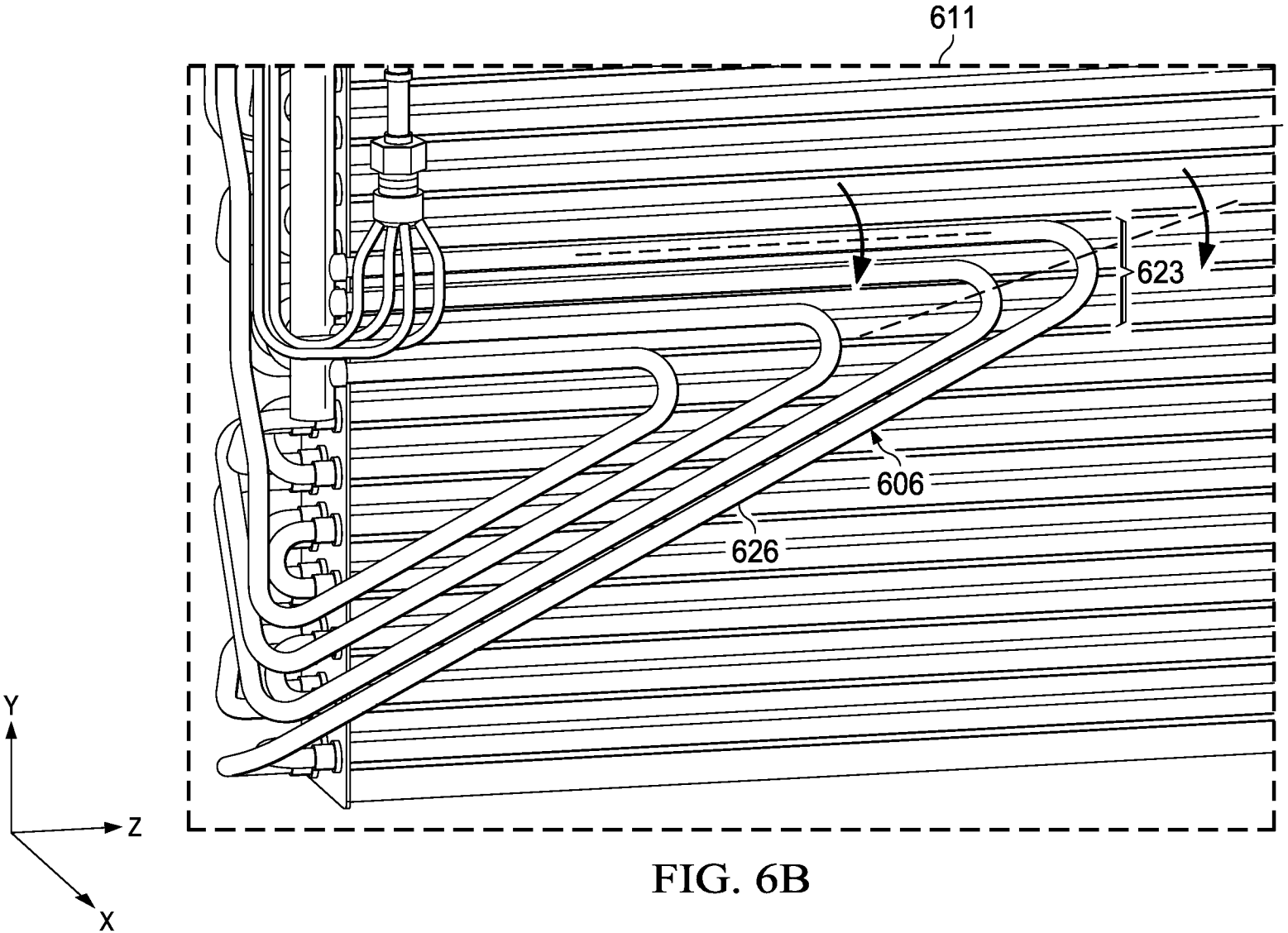
FIG. 6B is a schematic diagram illustrating an exploded view of a slanted v-shaped extension of gas circuit tubes within the air handling unit according to an embodiment of the disclosure.

Referring now to FIGS. 6A-B, a schematic diagram of an interior portion 600 of the air handling unit 200 is shown according to an embodiment of the disclosure. As shown in FIG. 6A, details of the inner surface 502 of the slab 250 comprising the heat exchanger assembly 209 are shown while the side 221 is shown as the outer surface of the slab 250. The inner surface 502 of the slab 250 may comprise a line set connection point 613, a liquid connection tube 616, and a gas connection tube 619. In some implementations, the liquid connection tube 616 may communicate refrigerant in the form of liquid between the heat exchanger assembly 209 and the outdoor unit 104. In some implementations, the gas connection tube 619 may communicate refrigerant in the form of gas between the heat exchanger assembly 209 and the outdoor unit 104. In some implementations, the line set connection point 613 may lead to the outdoor unit 104 and may communicate the refrigerant between the outdoor unit 104 and the heat exchanger assembly 209 via the liquid connection tube 616 and the gas connection tube 619.

In some implementations, the liquid connection tube 616 splits into multiple liquid circuit tubes 603, and the gas connection tube 619 splits into multiple gas circuit tubes 606. As shown in FIG. 6A, the multiple liquid circuit tubes 603 and the multiple gas circuit tubes 606 may connect to the various channels 630 within the heat exchanger assembly 209. In some implementations, a liquid circuit tube 603 has a small diameter and thick walls. In contrast, a gas circuit tube 606 has a larger diameter and thinner walls. In these implementations, the liquid circuit tubes 603 having thin diameters and thick walls are not easily susceptible to damage or kinking when the liquid circuit tubes 603 are bent, which may occur when the slab 250 is pivoted downward and outward. However, the gas circuit tubes 606 having thick diameters and thin walls are easily susceptible to damage and kinking when the gas circuit tubes 606 are bent, which may occur when the slab 250 is pivoted downward and outward.

According to some embodiments, a plane of the gas circuit tubes 606 and a length of the gas circuit tubes 606 may be changed to accommodate the bending of the gas circuit tubes 606 that may occur when the slab 250 pivots downward and outward. Instead of directly connecting the gas circuit tubes 606 straight from the gas connection tube 619 to the channels 630 in the heat exchanger assembly 209, the gas circuit tubes 606 may be lengthened and bent outwards and downwards in a slanted v-shape to connect to the heat exchanger assembly 209, as shown by box 611 in FIG. 6B.

Referring now to FIG. 6B, box 611 shows an exploded view illustrating the slanted v-shaped extension of the gas circuit tubes 606. As shown in box 611, the gas circuit tubes 606 may extend outward from the gas connection tube 619 and then bend downwards in a decline towards the edge of the heat exchanger assembly 209 to connect to the channels 630 in the heat exchanger assembly 209. In an embodiment, the gas circuit tubes 606 may extend from the gas connection tube 619 to the bend 623, and then from the bend 623 to connect to the heat exchanger assembly 209.

As shown by box 611, there are four gas circuit tubes 606 extending from the gas connection tube 619, and the four gas circuit tubes 606 are disposed such that the gas circuit tubes 606 do not overlap one another. However, it should be appreciated that there may be any number of gas circuit tubes 606, and the gas circuit tubes 606 may be disposed in an overlapping manner.

In some embodiments, the extension of the length 626 of the gas circuit tubes 606 and the slanted v-shaped bending of the gas circuit tubes 606 enable the gas circuit tubes 606 to accommodate the pivoting of the slab 250 downward and outward without bending, crimping, or otherwise damaging the gas circuit tubes 606. For example, the gas circuit tubes 606 stay connected to the gas connection tube 619 and the various channels 630 when the slab 250 pivots downward and outward, and the gas connection tube 619 and the liquid connection tub 616 remain stationary and do not move when the slab 250 pivots downward and outward. In some embodiments, the gas circuit tubes 606 torsionally bend along an axial direction (the z-axis) when the slab 250 pivots outward because the gas circuit tubes 606 are connected to the stationary gas connection tube 616 and the channels 630 on the heat exchanger assembly 209 that move as the slab 250 pivots downward and outward. For example, the gas circuit tubes 606 rotate about the bend 623 along the z-axis when the slab 250 pivots downward and outward. The torsional bend that occurs in the gas circuit tubes 606 when the slab 250 pivots downward and outward may reduce stress concentration on the gas circuit tubes 606 and prevents kinking or fatigue at the bend 623. When the slab 250 is returned to the closed position, the gas circuit tubes 606 also return to the original position as shown by box 611.

In some embodiments, the drain pan 219 is also positioned under the slab 250 of the air handling unit 200. The drain pan 219 may extend from the surface of the vertical side 221 and may be positioned under the air filter 211 and the heat exchanger assembly 209. As shown in FIG. 6A, a channel of the drain pan 219 may extend past the heat exchanger assembly 209 and may hold the condensation dripped down from the heat exchanger assembly 209, as is further described below with reference to FIG. 7.

Figure 7:
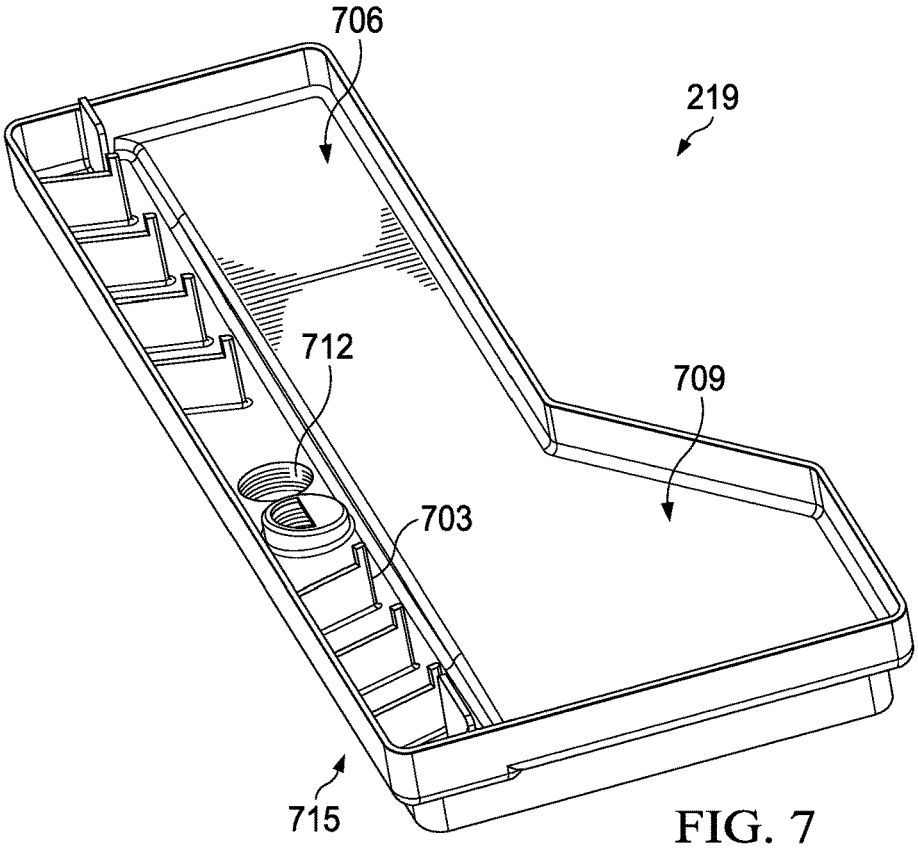
FIG. 7 is a schematic diagram of a drain pan included in the air handling unit according to an embodiment of the disclosure.

Referring now to FIG. 7, a schematic diagram of a drain pan 219 is shown according to an embodiment of the disclosure. In some embodiments, the drain pan 219 comprises one or more vertical supporters 703, a surface 706, a channel 709, and a drain port 712. In some embodiments, the vertical supporters 703 may be parallel groves that are configured to extend upward from a surface 706 of the drain pan 219. The vertical supporters 703 may be positioned at a front portion 715 of drain pan 219.

In some implementations, the drain pan 219 is disposed directly under the air filter 211 and at least partially under the heat exchanger assembly 209 within the cabinet 203. In one embodiment, the channel 709 may extend past the heat exchanger assembly 209 and may not be disposed under a component of the air handling unit 200. The surface 706 collects condensation dripping from the heat exchanger assembly 209 and may direct the condensation into the channel 709, which is angled toward the drain port 712. The vertical supporters 703 are configured to support the air filter 211 in a manner such that the air filter 211 does not contact the condensation collected in the drain pan 219. For example, the air filter 211 may be disposed on top of the vertical supporters 703 at the front portion 715 of the drain pan 219. One or more drain ports 712 may be positioned at the front portion 715 of the drain pan 219.

Figure 8:
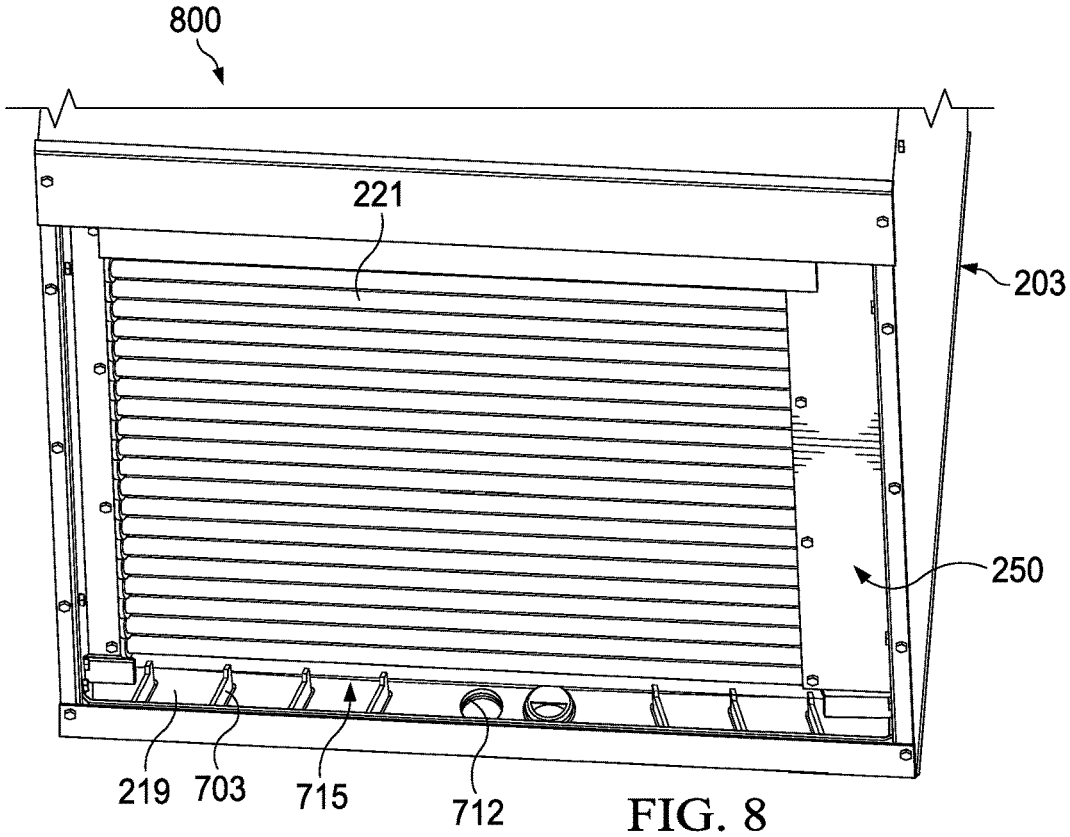
FIG. 8 is a schematic diagram of a portion of the air handling unit including the drain pan according to an embodiment of the disclosure.

Referring now to FIG. 8, a schematic diagram of a portion 800 of the air handling unit 200 is shown according to an embodiment of the disclosure. The portion 800 of the air handling unit 200 shows the side 221 of the air handling unit 200. In the implementation shown in FIG. 8, the air filter 211 is not yet disposed on the slab 250, and the vertical supporters 703 are exposed at the bottom of the air handling unit 200.

In some embodiments, the position of the drain port 712 at the front portion 715 of the drain pan 219 is advantageous because the drain port 712 may be easily examined and maintained by only having to remove the air filter 211 to access the drain port 712. For example, once the air filter 211 is removed, the drain port 712 may be easily inspected to determine whether the drain port 712 is clogged. Similarly, the placement of the drain port 712 may enable the clog to be cleared and maintained without having to disassemble the entire slab 250.

Figure 9:
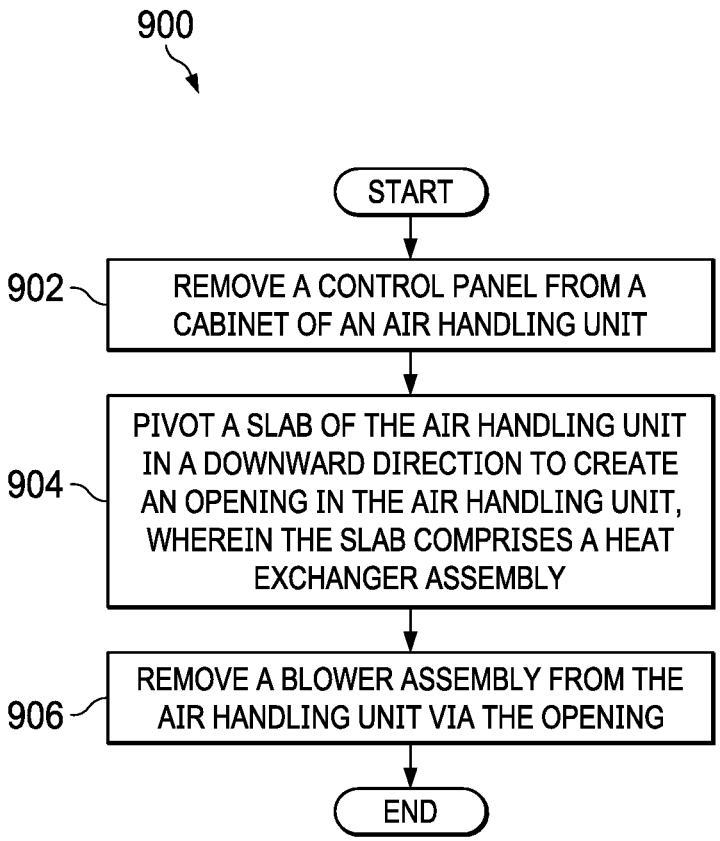
FIG. 9 is a flowchart of a method of operating an HVAC system with the air handling unit according to an embodiment of the disclosure.

Referring now to FIG. 9, a flowchart of method 900 of operating an HVAC system 100 with the air handling unit 200 is shown according to an embodiment of the disclosure. The method may begin at block 902 by removing a control panel 216 from a cabinet 203 of an air handling unit 200. For example, the control panel 216 may be removed by first removing a control panel cover 213 from the cabinet 203. The control panel cover 213 may be removed, for example, by removing screws that attach the control panel cover 213 to the cabinet 203. Similarly, the control panel 216 may be removed, for example, by removing screws that attach the control panel 216 to the cabinet 203. The method 900 may continue at block 904 by pivoting a slab 250 of the air handling unit 200 in a downward and outward direction to create an opening 255 in the air handling unit 200. In some embodiments, the slab 250 comprises the heat exchanger assembly 209. The method 900 may continue at block 906 by removing a blower assembly 206 from the air handling unit 200 via the opening 255.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Unless otherwise stated, the term "about" shall mean plus or minus 10 percent of the subsequent value. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. An air handling unit, comprising:

a cabinet;

a blower assembly positioned within the cabinet;

a slab positioned adjacent to and parallel to a vertical side of the cabinet, wherein the slab comprises a heat exchanger assembly; and at least one hinged connector that pivotally connects the slab to the cabinet.

2. The air handling unit of claim 1, wherein the slab further comprises at least one stop that is positioned a predefined distance from the at least one hinged connector such that the at least one stop prevents the slab from continuing to pivot downward and outward when the at least one stop meets an edge of a frame, wherein the frame secures the slab to the cabinet.

3. The air handling unit of claim 1, wherein at least two hinged connectors are disposed on two bottom corners of the slab to pivotally interconnect the slab to the cabinet such that the slab may be pivoted downward and outward using the at least two hinged connectors.

4. The air handling unit of claim 1, wherein the slab further comprises a plurality of gas circuit tubes that connect to the heat exchanger assembly, wherein each of the plurality of gas circuit tubes comprises a bend, and wherein the gas circuit tubes extend along a plane of the heat exchanger assembly and then decline downward and horizontally at the bend to connect to the heat exchanger assembly.

5. The air handling unit of claim 4, wherein the gas circuit tubes bend torsionally about the bend when the slab is pivoting downward and outward.

6. The air handling unit of claim 1, further comprising an air filter and a drain pan, wherein the slab comprises the air filter positioned parallel to the heat exchanger assembly, wherein the air filter is positioned as the vertical side of the cabinet, and wherein the drain pan is positioned under the air filter and the heat exchanger assembly.

7. The air handling unit of claim 6, wherein the drain pan comprises a plurality of vertical supporters that support the air filter such that condensation drips from the heat exchanger assembly to the drain pan.

8. A heating, ventilation, and/or air conditioning (HVAC) system, comprising:

an air handling unit comprising:

a cabinet;

a slab positioned adjacent to and parallel to a side of the cabinet, wherein the slab comprises a heat exchanger assembly; and at least one hinged connector that pivotally connects the slab to the cabinet.

9. The HVAC system of claim 8, wherein the slab further comprises at least one stop that is positioned a predefined distance from the at least one hinged connector such that the at least one stop prevents the slab from continuing to pivot downward and outward when the at least one stop meets an edge of a frame, wherein the frame secures the slab to the cabinet.

10. The HVAC system of claim 8, wherein at least two hinged connectors are disposed on two bottom corners of the slab to pivotally interconnect the slab to the cabinet such that the slab may be pivoted downward and outward using the at least two hinged connectors.

11. The HVAC system of claim 8, wherein the slab further comprises a plurality of gas circuit tubes that connect to the heat exchanger assembly, wherein each of the plurality of gas circuit tubes comprises a bend, and wherein the gas circuit tubes extend along a plane of the heat exchanger assembly and then bend downward and outward and horizontally at the bend to connect to the heat exchanger assembly.

12. The HVAC system of claim 11, wherein the gas circuit tubes bend torsionally about the bend when the slab is pivoting downward and outward.

13. The HVAC system of claim 8, wherein the air handling unit further comprises an air filter and a drain pan, wherein the slab comprises the air filter positioned parallel to the heat exchanger assembly, wherein the air filter is positioned as a side of the cabinet, and wherein the drain pan is positioned under the air filter and the heat exchanger assembly.

14. The HVAC system of claim 13, wherein the drain pan comprises a plurality of vertical supporters that support the air filter such that condensation drips from the heat exchanger assembly to the drain pan.

15. A method of operating a heating, ventilation, and/or air conditioning (HVAC) system, comprising:

removing a control panel from a cabinet of an air handling unit of the HVAC system;

pivoting a slab positioned adjacent to and parallel to a vertical side of the air handling unit in a downward and outward direction to create an opening in the air handling unit, wherein the slab comprises a heat exchanger assembly; and removing a blower assembly from the air handling unit via the opening.

16. The method of claim 15, wherein removing the control panel from the cabinet comprises removing a control panel cover from the cabinet before removing the control panel from the cabinet, wherein the control panel cover is a portion of the cabinet that protects the control panel.

17. The method of claim 15, wherein the slab comprises at least one hinged connector that pivotally connects the slab to the cabinet, wherein the hinged connector is positioned at a bottom corner of the cabinet, and wherein the pivoting of the slab is performed using the at least one hinged connector.

18. The method of claim 17, wherein the slab further comprises at least one stop that is positioned a predefined distance from the at least one hinged connector such that the at least one stop prevents the slab from continuing to pivot the downward and outward direction when the at least one stop meets an edge of a frame, wherein the frame secures the slab to the cabinet.

19. The method of claim 15, wherein the slab further comprises a plurality of gas circuit tubes that connect to the heat exchanger assembly, wherein each of the plurality of gas circuit tubes comprises a bend, and wherein the gas circuit tubes extend along a plane of the heat exchanger assembly and then bend downward and horizontally at the bend to connect to the heat exchanger assembly.

20. The method of claim 19, wherein the gas circuit tubes bend torsionally about the bend when the slab is pivoting in the downward and outward direction.

* * * * *